US005492431A

United States Patent [19]

Rasmussen et al.

[11] Patent Number: 5,492,431

[45] Date of Patent: Feb. 20, 1996

[54] METHODS FOR CUTTING ALIGNED SETS OF SLOTS IN PAVEMENT

[75] Inventors: James E. Rasmussen, Marathon, Fla.; Larry Mosher, Lebananon, Tenn.; James K. Godwin, Sheridan, Ark.; Larry Swanda, Ankeny, Iowa; Robert W. Given, White Hall, Ark.; Jerry Maynard; Thomas Sidler, both of Lebananon, Tenn.; Ronald E. Stewart, Pine Bluff; Richard D. Turnbow, Star City, both of Ark.

[73] Assignee: Concrete Textures, Inc., Des Moines, Iowa

[21] Appl. No.: 203,621

[22] Filed: Mar. 1, 1994

[51] Int. Cl.[6] ..... E01C 7/06

[52] U.S. Cl. ..... 404/75; 404/87

[58] Field of Search ..... 404/47, 48, 49, 404/52, 62, 68, 89, 90, 91, 92, 93, 94, 87; 299/38, 39, 81

[56] References Cited

U.S. PATENT DOCUMENTS

| | | | |
|---|---|---|---|
| 894,269 | 7/1908 | Hendron . | |
| 2,244,742 | 6/1941 | Tyson | 262/20 |
| 3,104,600 | 5/1959 | White | 404/47 |
| 3,605,579 | 9/1971 | Heltzel | 94/45 |
| 3,702,093 | 11/1972 | Van De Loock et al. | 94/8 |
| 4,392,689 | 7/1983 | Moore et al. | 299/39 |
| 4,493,584 | 1/1985 | Guntert | 404/74 |
| 4,900,094 | 2/1990 | Sergeant | 404/90 |
| 4,909,575 | 3/1990 | Lupton | 299/39 |
| 5,192,160 | 3/1993 | Muehlstaedter | 404/90 |
| 5,215,071 | 6/1993 | Mertes et al. | 299/39 |

FOREIGN PATENT DOCUMENTS

| | | | |
|---|---|---|---|
| 0283286A2 | 9/1988 | European Pat. Off. | 23/8 |

*Primary Examiner*—Ramon S. Britts
*Assistant Examiner*—Pamela A. O'Connor
*Attorney, Agent, or Firm*—Zarley, McKee, Thomte, Voorhees & Sease

[57] ABSTRACT

An apparatus and method for simultaneously cutting parallel slots in a pavement surface is provided, especially for dowel bar retrofit load transfer restoration at joints. The apparatus includes a movable frame lockable with a brake, plurality of parallel cutting blades rotatably mounted on twin cutting heads on the frame, vertical travel unit for raising and lowering the blades independently or in unison, and horizontal travel units for moving the blades horizontally. One of the twin cutting heads is mounted on each side of the frame, with hydraulic adjusting rams for independently setting the width therebetween. A slurry control system which is mounted on the frame provides the blades with coolant and vacuums up the slurry produced during cutting. The method for simultaneously cutting a plurality of slots includes the steps of positioning the apparatus and blades in the desired location, locking the machine against movement relative the surface, rotating the blades, lowering the blades to cut the pavement to a first depth, moving the blades horizontally to form an elongated cut, repeating this plunging and traversing process until the desired depth of cut is achieved, raising the blades and moving the apparatus. The pavement between the parallel cuts is easily removed by a jack hammer.

31 Claims, 7 Drawing Sheets

METHODS FOR CUTTING ALIGNED SETS OF SLOTS IN PAVEMENT

BACKGROUND OF THE INVENTION

This invention relates to the field of pavement reinforcement. More particularly, the invention relates to means and methods for cutting aligned sets of slots in pavement to accommodate the insertion of steel dowel bars for reinforcing faulted areas adjacent joints in the paving.

Pavement on streets, highways, air strips and the like is subject to wear and deterioration from, among other forces, the repeated travel of vehicles thereon. In the case of highways, the majority of the wear is known to follow a particular pattern. After the passage of a multitude of vehicles along a highway, a wear pattern develops and is evidenced by a pair of indentations or wheel paths in each lane of the pavement.

Another kind of deterioration which is prevalent on well-traveled strips of pavement is faulting at the expansion joints. Where the wheel paths intersect the transverse joints, the pavement is known to suffer repeated heavy loading due to the passage of traffic thereover. As a result, the pavement around the transverse joint is subject to a type of premature fatigue failure known as faulting. Load transfer restoration (LTR) is known to improve the load transfer across a joint and reduce the rate of future fault development. Load transfer describes the distribution of load across a transverse joint of pavement under vehicular traffic. Aggregate interlock, dowel bars and subbase support influence the degree of load transfer. The ability of a joint to distribute load is fundamental to its performance and is characterized by joint effectiveness measurements. Poor load transfer is typically evidenced by a loss of structural integrity such as faulting and, if not corrected, cracking and crumbling of the pavement near the joint.

Restoring load transfer at joints is necessary to stop pavement deterioration. It may be necessary because a designer omitted dowels in an existing pavement and subsequent joint faulting has become a problem or deicing chemicals have corroded unprotected dowels. In either case, load transfer restoration (LTR) places good mechanical load transfer in the joint. Undoweled joints lose load transfer faster than those with dowels under similar traffic. A joint effectiveness of 50 percent or more is considered adequate for typical heavy truck loadings. LTR improves load transfer and reduces the rate of future fault development across joints or transverse cracks on concrete pavements.

Backfill refers to the material used to fill in the slot after the dowel has been installed. A good bond between the backfill and slot/core walls is essential for LTR performance. The bond helps carry the load in shear across the joint. Therefore, careful preparation of the slot is essential.

The slots for dowels are cut in the wheel paths, parallel to the pavement centerline and with each other. Careful alignment is essential for optimum performance. Conventionally, the pavement surface is ground after the cutting, chipping, and cleanout and backfilling processes.

A common load transfer assembly includes a horizontally disposed oiled steel dowel bar. The typical heaving truck loading often necessitates the use of a plurality of dowel bars to appropriately transfer the load across the wheel path. At least three dowels in each wheel path are known in the art to be recommended on roadways subject to heavy truck traffic. Because existing highways can be easily retrofitted with steel dowel bars at the transverse joints, dowel bar retrofitting provides a quick and inexpensive alternative to completely removing the road surface and repaving it with load transfer assemblies embedded therein.

Conventionally, contractors have employed saws equipped with gang-mounted diamond-impregnated blades to cut a single slot of the desired width and location at one time. These saws are typically rotatably mounted to a frame. The whole machine, saw and frame included, must be moved to affect the desired cut. Such saws have typically been limited to cutting only one side wall of the slot at a time or cutting both side walls of a single slot at one time. Such an arrangement may provide the necessary alignment between the side walls of a single slot, but does not provide the necessary alignment between a set or group of slots.

In conventional saws having one to four blades, cooling and safe operation are problems. Some saws spray liquid on the blade for cooling it, resulting in slurry material which presents unsafe conditions for the operator and passersby, including vehicular traffic.

Therefore, it is the objective of this invention to provide means and methods for simultaneously cutting a plurality of slots at joints in pavement to form an aligned group of slots suitable for the retrofit installation of dowel bars for load transfer restoration.

It is a further objective of this invention to provide a quick and efficient means and method for load transfer restoration of pavement.

It is a further objective of this invention to provide a means for cutting slots in pavement wherein the cutting blade is movable vertically and horizontally during the cutting process without moving the vehicle to which the cutting blade is mounted.

It is a further objective of this invention to provide a means for setting the width between the right and left set of slots in a group of aligned slots.

It is a further objective of this invention to provide means for canting the cutting blades to ensure square entry of the blades into the pavement, even when the pavement surface is not flat and level.

It is a further objective of this invention to provide an aligned group of slots, each slot side walls and a bottom which are well adapted to have a plurality of chairs snugly fit between the side walls of each slot for accurately positioning and supporting a dowel bar which is snapped in the chairs.

It is a further objective of this invention to provide a means for cutting slots in pavement wherein the blade assembly is movable horizontally, vertically, and laterally relative to the vehicle frame to which the blade assembly is mounted.

It is a further objective of this invention to provide a means of adjusting the vertical height of the blade and setting its depth of cut.

It is a further objective of this invention to provide means and methods for joint load transfer restoration of pavement which can be accomplished with a minimum of labor.

It is a further objective of this invention to provide a safe and efficient means and methods for cutting slots in a pavement surface.

SUMMARY OF THE INVENTION

This invention provides an apparatus and methods for cutting a plurality of parallel slots in pavement, generally at a transverse joint thereof, for purposes of dowel bar retrofit for joint load transfer restoration.

The apparatus includes a movable frame lockable with a brake operatively associated therewith, a plurality of parallel cutting blades rotatably mounted on the frame, a source of rotary power for rotating the blades, at least one vertical travel unit for raising and lowering the blades relative to the frame and pavement surface, and at least one horizontal travel unit for moving the blades horizontally relative to the frame and surface. Means for canting the axis of rotation of the blade from horizontal is also provided.

The apparatus includes twin cutting blade assemblies, one mounted on each side of the frame. Furthermore, these groups of blades can be rotated, canted, and moved independently of each other by hydraulic motors, mechanical adjustments, and rams respectively. Each blade assembly is also movable laterally to adjust the width between the assemblies so as to position the blades over the wheel paths in the pavement being retrofitted with dowel bars. A slurry control system is also mounted on the frame and operatively associated with the blades to cool the blades and to vacuum up any pavement dust slurry generated during cutting. The machine can be rollingly supported on a plurality of wheels, at least one of which is lockable with a hydraulically actuatable brake.

The method of the present invention includes the steps of positioning the machine and the blades in the desired slot-cutting position, locking the machine against movement relative to the surface, rotating the blades of one or both of the twin cutting blade assemblies, lowering the rotating blades to cut to a first depth, moving the rotating blades horizontally to form an elongated cut in the pavement, further lowering the rotating blades to a second depth, moving the rotating blades in a return horizontal path, raising them from the cuts, moving the machine, and removing the pavement between pairs of cuts. Pavement removal at joints is accomplished by as few as three carefully placed hits with a jack hammer.

DETAILED DESCRIPTION OF THE PREFERRED EMBODIMENT

Figure 1:
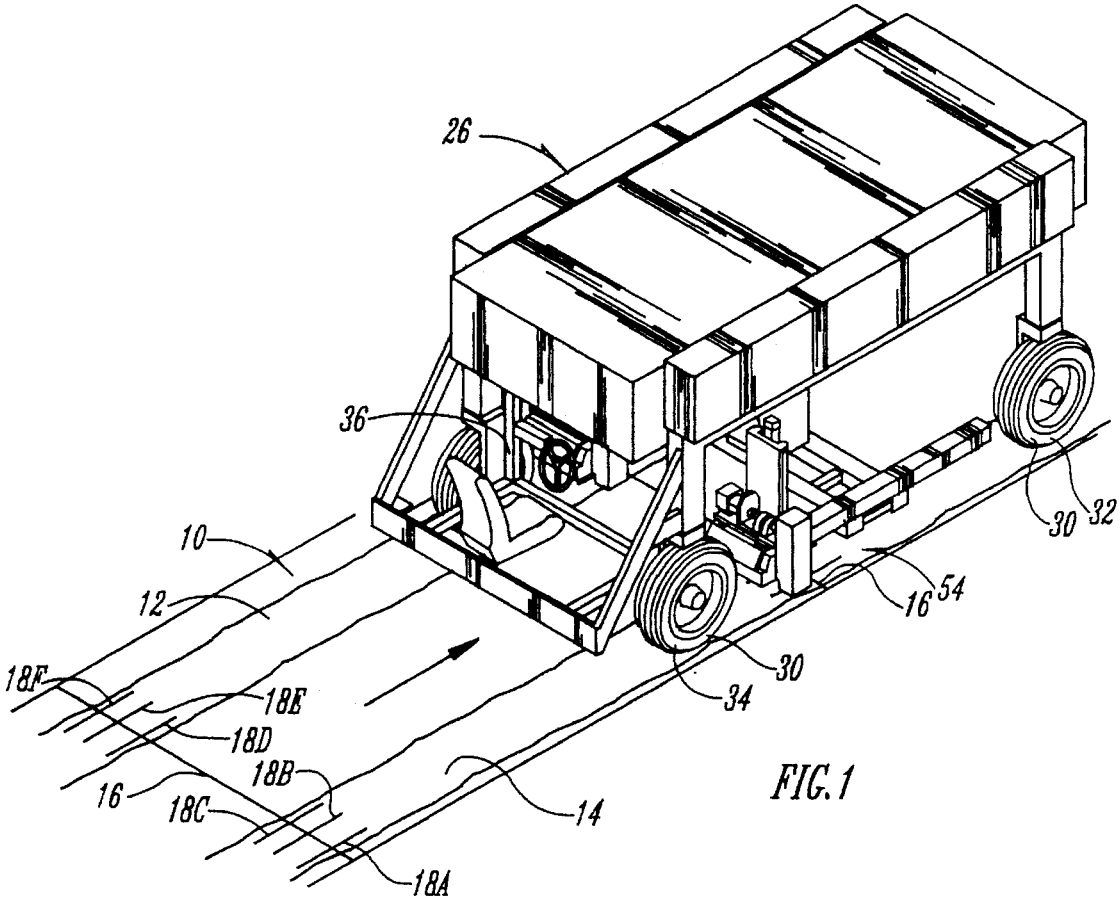
FIG. 1 is a perspective view of the slot cutting machine of the present invention which also shows the slotted pavement.

FIG. 1 shows the slot cutting machine 26 of this invention on a pavement surface 10 which has been in service for some time. With the passage of vehicular traffic in the direction shown, slightly recessed right and left wheel paths 12 and 14 have developed. Because heavy trucks inflict the most wear on roads, the pattern generally corresponds to the usual path of these trucks. On a typical twelve foot wide lane of pavement, the right wheel path is approximately twelve inches inward from the right edge while the left wheel path 14 is typically about 24 inches inward from the left edge of the pavement. A transverse contraction joint 16 runs across the pavement.

For effective load transfer restoration, a group of three longitudinal slots 18A, 18B, 18C; and 18D, 18E, 18F must be cut in wheel paths 12 and 14 respectively. For most effective load transfer, the centers of the slots must be located twelve inches apart in each group, with a spread of 60 inches between the centers of slots 18C and 18D.

Figure 2:
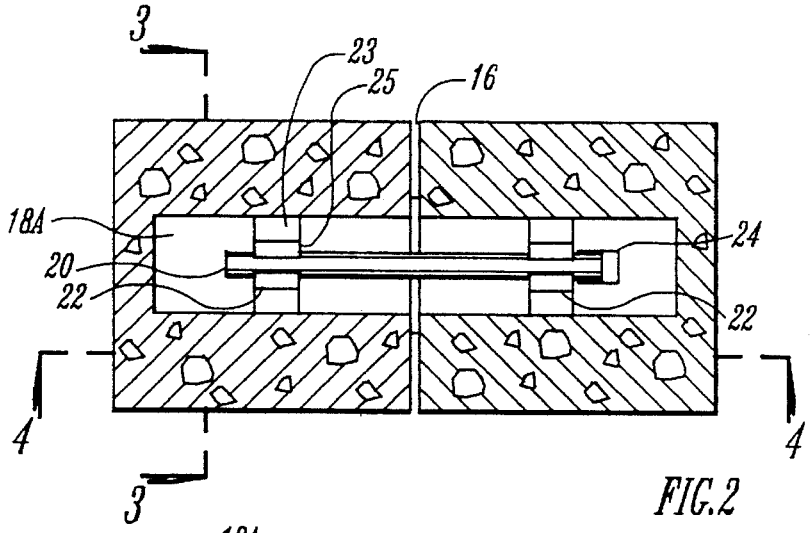
FIG. 2 is an enlarged top view of a dowel bar installed in a load transfer restoration slot.

FIG. 2 is an enlarged view of the longitudinally elongated slot 18A which is substantially identical to the other slots 18B, 18C, 18D, 18E and 18F. Therefore, the description will refer to slot 18A, with the understanding that the other slots 18B–F have the same description.

Each slot extends substantially an equal distance on either side of transverse joint 16. An elongated steel dowel bar 20 is positioned within each slot. The width of each slot is preferably no greater than 2.25 to 2.5 inches. The width of dowel bar 20 is preferably between 1.25 and 1.5 inches in diameter. The length of the dowel is approximately eighteen inches. Each dowel 20 is supported at either end by plastic chairs 22 which are placed in each slot. An expansion cap 24 is attached to one end of each dowel bar 20.

Figure 3:
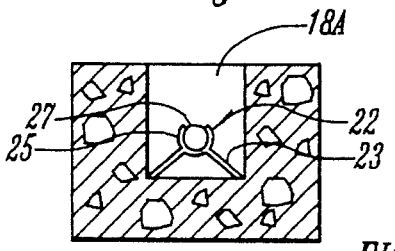
FIG. 3 is a side elevation view taken along line 3—3 in FIG. 2 showing a dowel bar mounted in a chair in the slot.
Figure 4:
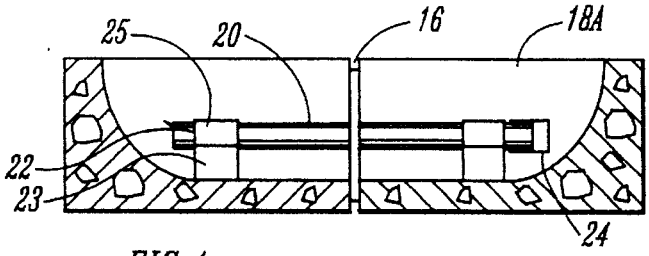
FIG. 4 is a front elevation view taken along line 4—4 in FIG. 2 of a load transfer restoration slot having a dowel bar installed therein.

In the preferred embodiment, two plastic chairs 22 are placed as shown in FIGS. 2–4. As best seen in FIG. 3, chair 22 has two legs 23 which are outwardly directed from a generally round tubular seat portion 25 having a gap 27 at the top thereof. Gap 27 is not as wide as dowel bar 20, but is wide enough that the dowel bar can be manually snapped into seat portion 25 so as to be firmly attached thereto. The outwardly directed legs 23 of chair 22 have a spread between their free ends that is slightly greater than the width of the slot 18A. Thus, the legs 23 must be forced toward each other in order to insert chair 22 into slot 18A. When inserted into slot 18A, the legs are released and tend to spring outwardly against the bottom and side walls of slot 18A to snugly position chair 22 in the desired location. Therefore, the position (especially the depth) of oiled steel dowel bar 20 with an expansion cap 24 attached thereto, is properly controlled by snapping the bar into chairs 22 which are preinserted in the slots.

FIG. 4 shows that the bottom of slot 18A is flat only in the center portion where dowel bar 20 is placed. The ends of slot 18A are curvilinear due to the entry and exit of the cutting blade.

Figure 5:
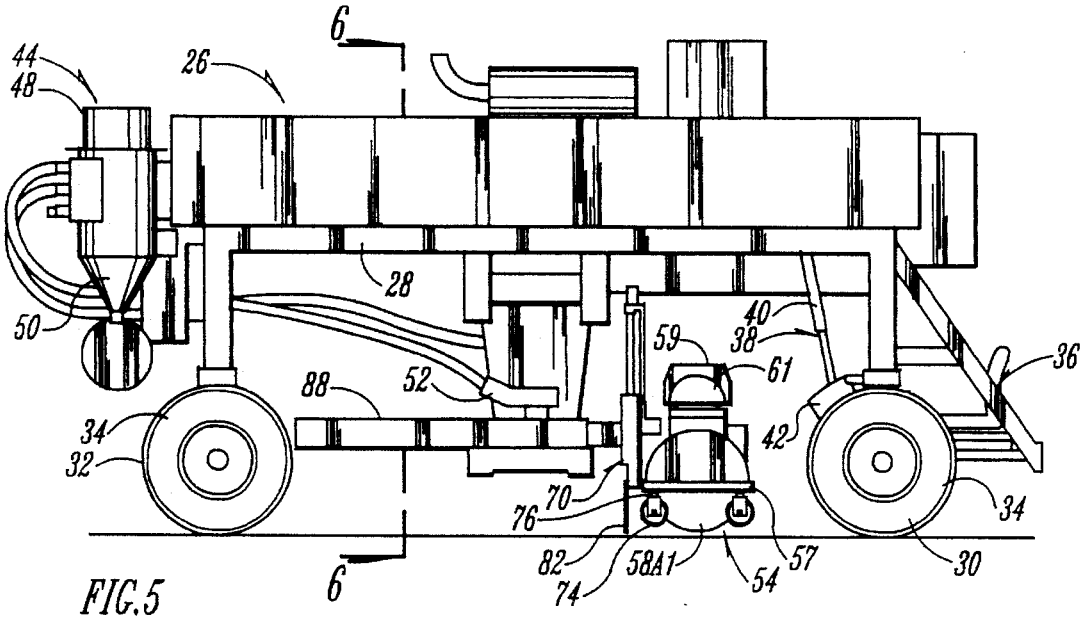
FIG. 5 is a side elevation view of the slot cutting machine of this invention.

FIG. 5 shows the slot cutting machine 26 having a frame 28 rotatably supported by a plurality of wheels including rear wheels 30 and steerable front wheels 32. Machine 26 is propelled by a conventional 400 horsepower diesel engine (not shown) mounted on frame 28. It should be understood that, because the machine is towed to and from the cutting site instead of having its own high speed traveling capability, a relatively small horsepower engine suffices. Machine 26 is propelled by the above-mentioned engine at relatively low speed as it travels from one joint 16 to the next. The tires 34 on front and rear wheels 30 and 32 are filled with foam on site to provide greater stability to the machine during the slot cutting operation.

An operator station 36 is provided at the rear of the machine. The operator station 36 is provided with conventional means of operating parking brake assemblies 38, each having a hydraulic brake ram 40 with an upper end attached to frame 28 and a lower end attached to a brake shoe 42. The rear of each brake shoe 42 is pivotally attached to frame 28 just above the respective rear wheel 30. When the ram 40 is hydraulically extended, the lower front portion of each brake shoe 42 is forced or pivoted into braking engagement with the rear wheel 30, preventing horizontal movement of machine 26, especially during the cutting of the slots. Since the machine 26 remains stationary during the cutting of the slots, it does not require a complex and expensive load control system.

A slurry control system 44 is mounted on the front of frame 28. The slurry control system 44 includes a hydraulically driven air blower 48 which provides vacuum for slurry control. The slurry control system 44 draws water for the cooling slurry from a conventional water tanker (not shown) which is located near slot cutting machine 26 during its operation. Furthermore, the slurry control system 44 includes a separator tank 50. The air blower 48 is connected by hoses 49 to vacuum manifolds 52. A plurality of intake hoses 53 are connected to vacuum manifolds 52 and are closely directed toward the cutting blades (described below). In the preferred embodiment, three to eight intake hoses 53 are associated with the cutting blades on the right side of the machine and the three to eight intake hoses 53 are associated with the cutting blades on left side of the machine.

Figure 6:
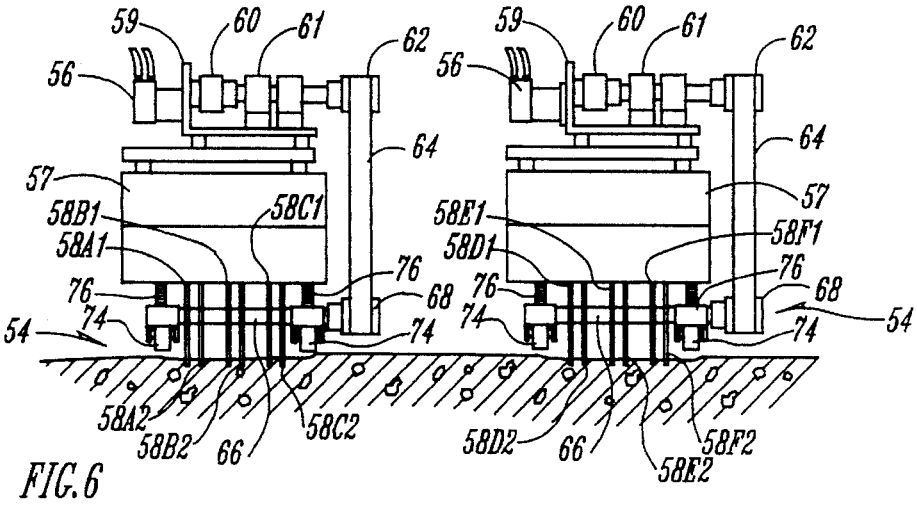
FIG. 6 is a front elevation schematic view taken along line 6—6 in FIG. 5 showing the right and left cutting blade assemblies engaged in cutting slots in the pavement.

In the preferred embodiment, a twin cutting head assembly 54 is mounted on either side of the machine. Each of these twin cutting head assemblies 54 carries a plurality of cutting blades 58 as shown in FIG. 6. Preferably, each assembly has six parallel blades, grouped in pairs, and each blade preferably being ⅛ inch thick and eighteen inches in diameter. A hydraulic head motor 56 is mounted on an L-shaped bracket 59 at the top of a head box 57 (see FIG. 5) in each cutting head assembly 54 and rotates a plurality of diamond-impregnated cutting blades, designated in the drawings with reference numerals 58A1, 58A2, 58B1, 58B2, 58C1, 58C2 or 58D1, 58D2, 58E1, 58E2, 58F1, 58F2 respectively. The blades are associated in pairs, i.e., 58A1 and 58A2, 58B1 and 58B2, etc., with each pair of blades being used to cut a respective slot 18A, 18B, etc.

Figure 7:
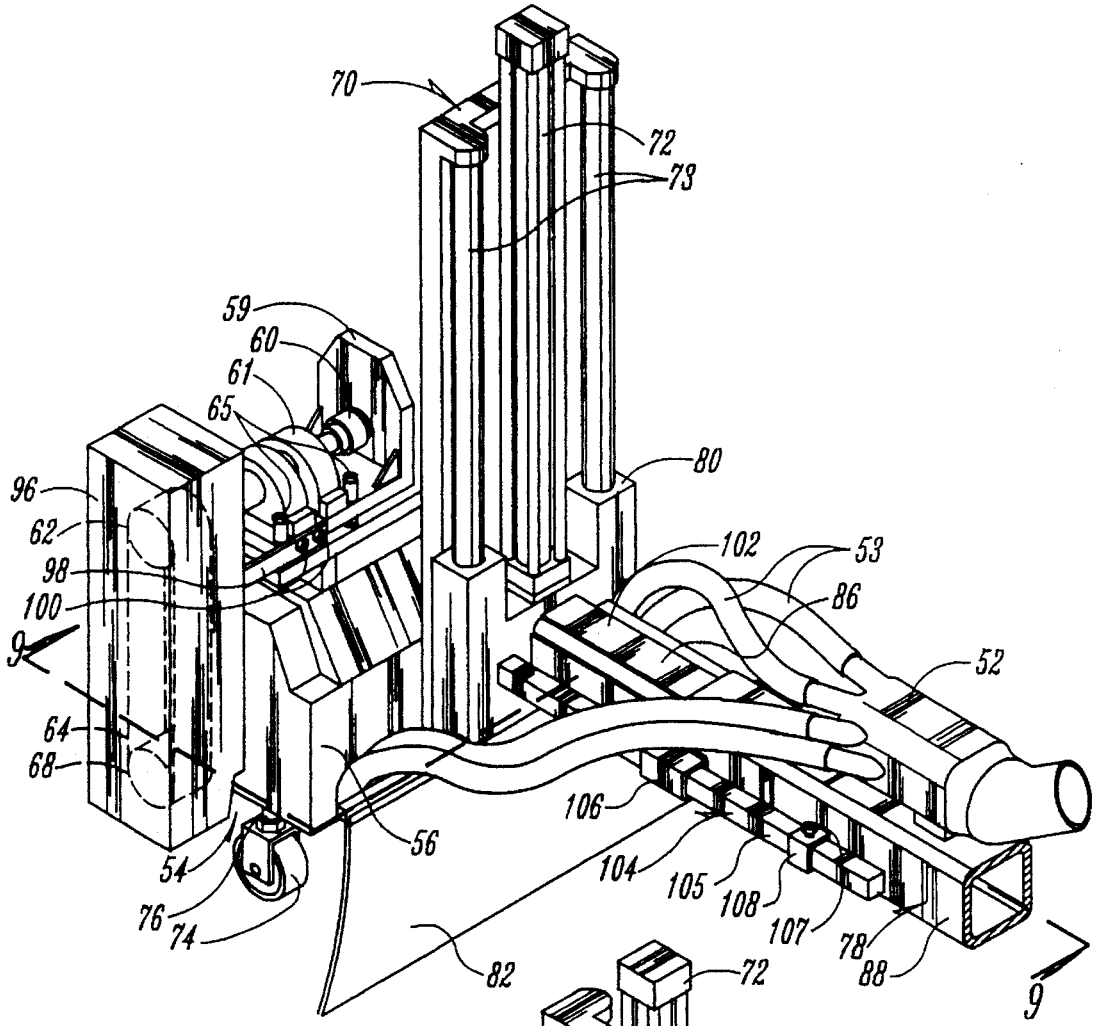
FIG. 7 is a perspective view of the cutting head of the slot cutting machine of this invention showing the means for vertically and horizontally moving the cutting head.
Figure 8:
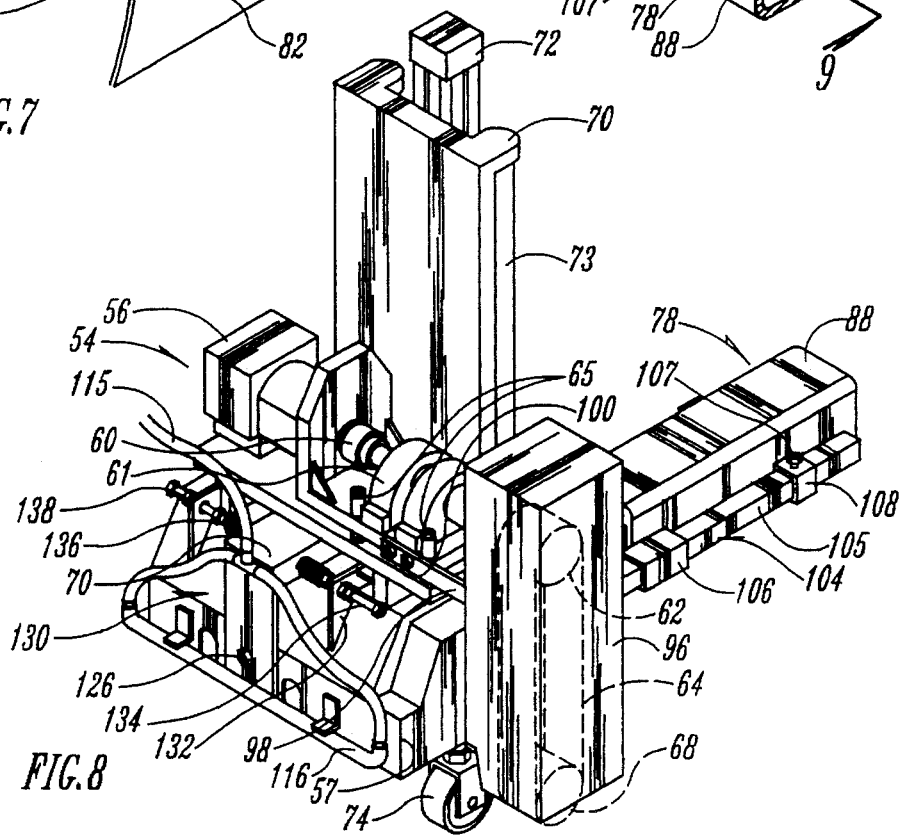
FIG. 8 is a perspective view of the cutting head assembly showing the spray bar of the present invention.

Only the right cutting head assembly 54 shown in FIG. 7, as viewed from the operator station 36, is described in detail below. The left cutting head assembly is substantially identical and is shown in FIG. 8. FIG. 7 shows that rotational power is transferred from the hydraulic head motor 56 to a head drive 60 on the opposite side of an L-shaped mounting bracket 59 and through a set of conventional jack shafts 61, to an upper set of pulleys 62. The tension on belt 64 can be varied with adjustment screws 65 which raise or lower jack shafts 61.

Figure 9:
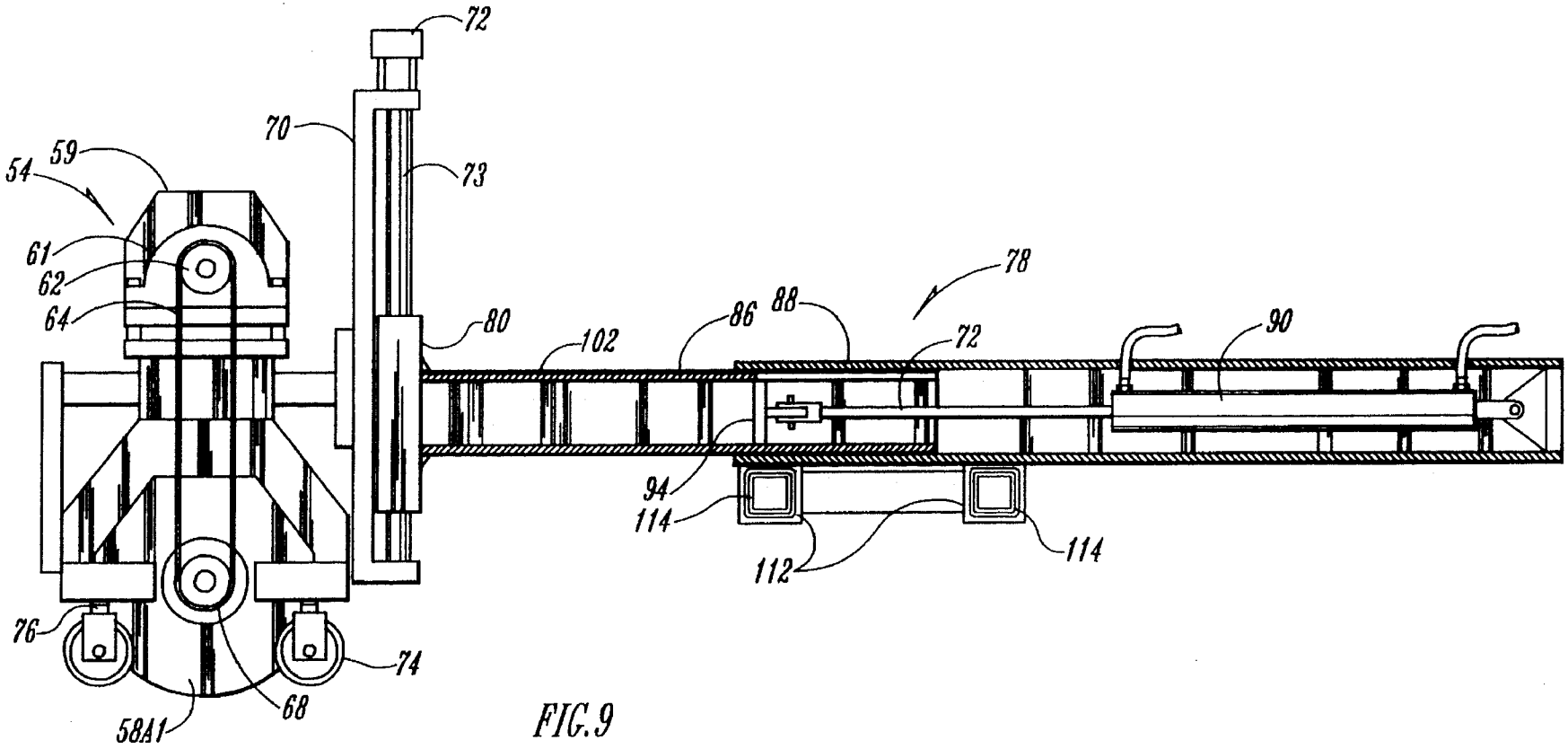
FIG. 9 is a partial cross sectional view of the horizontal travel unit and head assembly taken along line 9—9 in FIG. 6.

As shown in FIGS. 6 and 9, a drive belt 64 drivingly connects blade shaft 66 to upper pulleys 62 via lower pulleys 68. In the preferred embodiment, the drive belts 64 are Poly Chain® GT® belt manufactured by the Gates Rubber Company. This belt and pulley combination handles considerable torque without slipping. The belt and pulley drive system of the present invention allows relatively small pulleys to be used, which leaves a greater portion of the blades 58A1 et. seq. exposed and available for deep cutting purposes. Because the cutting blades must extend below lower pulleys 68 far enough to reach the required depth of cut, it should be understood that the minimum diameter of the cutting blades 58A1–58F2 is a function of the desired depth of cut and the diameter of the lower pulleys. Therefore, it should be apparent that smaller diameter cutting blades 58 can be utilized with the present invention, due to the smaller size of pulleys 62, 68. Since the expense of diamond-impregnated blades is also a function of the blade diameter, considerable savings in cutting blade expense can be achieved with the smaller blades of the present invention. Furthermore, less power is consumed by cutting with smaller blades.

FIG. 6 depicts the spatial relationships between the individual blades, pairs of blades, groups of blades, and the pavement surfaces when both groups of blades are lowered to cut in unison. It should be understood that the relationships necessary to precisely cut groups of aligned slots are accurately controlled by the present invention. Each blade within each pair of blades 58A1 and 58A2; 58B1 and 58B2; et. seq. is fixed on blade shaft 66 in the precise position required to squarely cut the side walls of the slot 18. A group of three pairs of blades 58A1, 58A2; 58B1, 58B2; 58C1, 58C2 are fixed for rotation on one blade shaft and a group of three pairs of blades 58D1, 58D2; 58E1, 58E2; 58F1, 58F2 are on the other blade shaft.

As best seen in FIGS. 7 and 8, the whole cutting head assembly 54 is operatively connected to a vertical travel unit assembly 70 having a hydraulically operated head lift ram 72 and vertical guide bars 73 for lowering (plunging) and raising (retracting) the cutting head assembly. The guide bars 73 are slidably mounted in a vertical guide 80. The guide 80 can also act as a positive stop on the movement of vertical travel unit 70. However, as discussed below, the depth of the blades from the pavement surface is generally more crucial than maintaining a given vertical travel distance. The movement of the cutting head assembly is driven by ram 72.

FIGS. 5 and 6 show that the final depth of the cut for the right and left cutting head assemblies 54 is independently adjustable by the extension of hard neoprene depth wheels 74 mounted to each corner of head box 57 by a threaded rod and nuts which comprise a vertical adjustment assembly 76. Because depth wheels 74 are in direct contact with the pavement at final depth, cutting blade protrusion and thus the depth of the slot relative to the pavement surface are very accurately maintained.

In preferred embodiment, two depth wheels 74 are mounted near each end of blade shaft 66. One of the two wheels 74 is disposed forward of blade shaft 66 and the other is rearward of the blade shaft. Viewing FIGS. 5 and 9 the positioning, mounting, and independence of depth wheels 74 can be understood.

A shield 82 is attached to the lower portion of vertical guide 80 to help keep dust, coolant, and a slurry mixture from being diverted away from the intake hoses 53 of the vacuum manifolds 52 located near the blades 58A1, 58A2, 58B1, 58B2, et. seq. (See FIG. 7) Shield 82 is made of a stiff rubber material similar to the mud flap on a truck. Shield 82 acts like a mud flap in containing the byproducts of the cutting process.

In FIG. 7, a horizontal travel unit assembly 78 is attached to the vertical guide 80 by suitable means for fastening, preferably welding. The horizontal travel unit assembly 78 is shown in greater detail in FIG. 9. An elongated inner tubular member 86 is welded to the vertical guide 80 (opposite head box 57) so as to extend forwardly in a substantially horizontal position. The inner tubular member 86 is slidably guided and telescoped into outer tubular member 88, which is mounted to the frame of the machine as described later. One end of a hydraulic cylinder 90 is pivotally mounted in a horizontal position at the distal end of the outer tubular member 88 and has a rod 92 extensible therefrom based on the pressure in cylinder 90. The rod 92 extends inside the inner tubular member 86 and is pivotally connected to a pusher plate 94 which is welded or otherwise suitably attached across the inside of inner tubular member 86. In the preferred embodiment, 8"×8"×½" square tubing is used for the outer tubular member and 6"×6"×½" square tubing for the inner tubular member.

When pressurized fluid flows to the cylinder 90 via a conventional hydraulic hose, the rod 92 is extended, thus telescoping inner tubular member 86 horizontally outward from outer tubular member 88 and moving the whole cutting head assembly horizontally or longitudinally in a precise, accurate and controlled manner.

As best seen in FIG. 8, a protective safety shroud 96 made of sheet metal, plastic, or other rigid, protective but easily formable material covers the area around pulleys 62 and 68 and belt 64. Shroud 96 is attached to the lower portion of L-shaped mounting bracket 59 by bracket arms 98 and conventional fastening means 100. Shroud 96 deters anyone from becoming engaged with the moving parts inside while protecting the machinery from debris and impact from outside forces.

Referring to FIG. 7, the smoothness and precision of the movement of the horizontal travel unit assembly 78 is facilitated by wear strips 102 fixed to the outside of inner tubular member 86. In the preferred embodiment, 4"×½" thick wear strips such as part number MUHW6408 manufactured by Solidur have been found to perform well in reducing friction, noise, and wear when affixed to all four outer sides of inner tubular member 86 prior to its insertion into outer tubular member 88.

FIGS. 7 and 8 show mechanical limiting adjustment means 104 for setting the length of the cuts. Two 2"×2" steel support rods 105 are fixed to extend horizontally from opposite sides of the vertical guide 80 and slide through horizontally aligned guide/stop tubes 106 which are mounted to the sides of the outer tubular member 88. Support rods 105 lend additional support and guidance at the junction of the inner and outer tubular members 86 and 88. Furthermore, as best seen in FIGS. 7 and 8, a 108 tubular stop is movable along rod 105. Therefore, various lengths of cuts can be set by selectively positioning stop 108 and tightening set screw 107.

Figure 10:
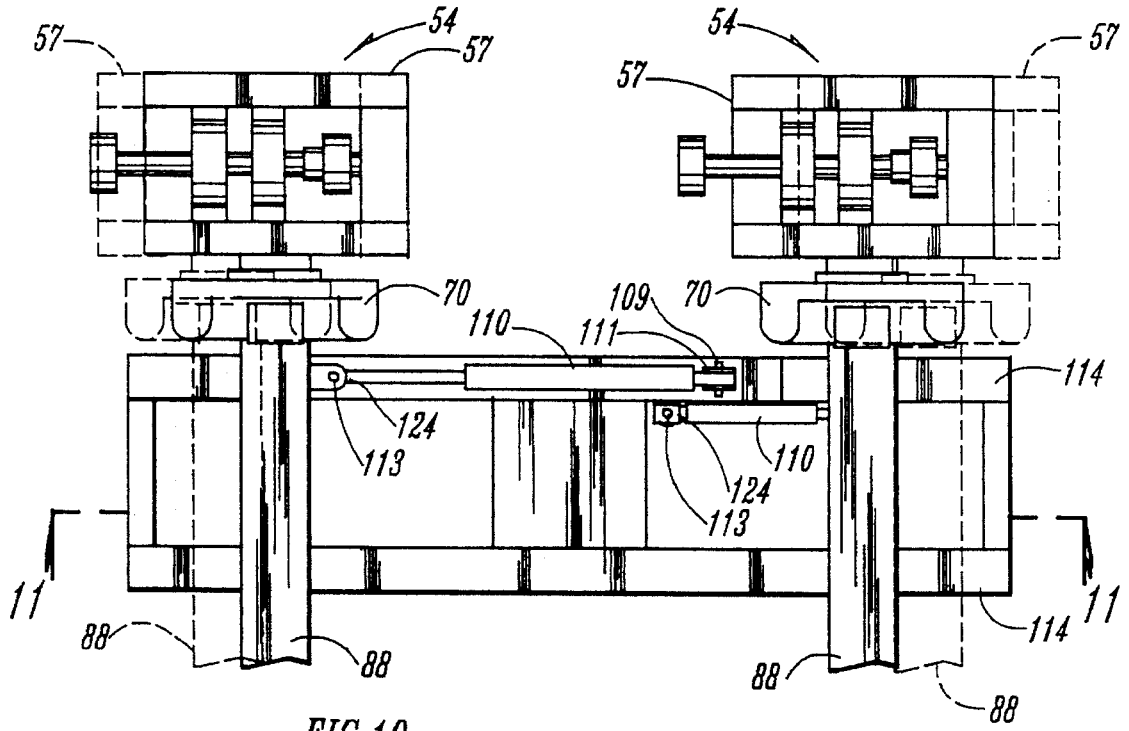
FIG. 10 is a top view of the right and left cutting head assemblies showing the means for adjusting the width between them.
Figure 11:
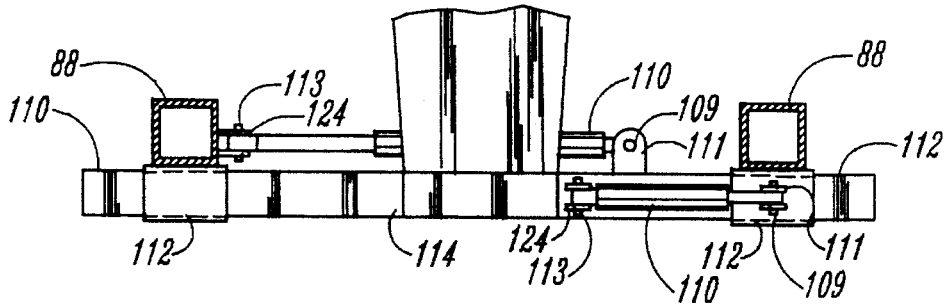
FIG. 11 is a front view taken along line 11—11 in FIG. 10 showing the lateral adjustability of the cutting head assemblies in this invention.

FIGS. 10 and 11 show that, in addition to the vertical and horizontal (longitudinal) movement already discussed, the present invention also provides independent transverse or lateral movement of each cutting head assembly 54 to account for variations in wheel path location. More particularly, a pair of width adjusting hydraulic cylinders 110 are operatively associated with the frame 28 and the cutting head assembly 54. The ram end of each cylinder 110 is connected to the respective outer tubular member 88 by pins 109 and brackets 111. The other end of each cylinder 110 is connected by pin 113 to a bracket 124 mounted on a transverse rail 114 of frame 28. As shown in FIG. 11, a tubular guide 112 is fixed, preferably welded, to the bottom of each outer tubular member 88 and has a laterally extending opening through which a transverse rail 114 slides when the cutting head assembly 54 is urged to move transversely by cylinder 110. Essentially, each cutting head assembly 54 slides independently inwardly and outwardly along rails 114 as driven by its own cylinder.

The cutting heads are precisely positionable to span the wheel paths and cut the slots for dowel bar insertion in the best locations for effective joint load transfer restoration. One benefit of the transversely positionable heads is that they are extendable as needed to cut slots in a 12 foot wide lane of pavement, but can be retracted to a width of 8 foot or less for transport of the slot cutting machine. Flags, wide load signs, advance and trailing signal vehicles, and the like do not have to be used when transporting the machine to and from the site.

Another advantageous feature of the present invention is apparent in FIG. 8. Blade shaft 66 is rotatably mounted to the cutting head assembly 54 in a substantially horizontal position. However, cant adjustment means 130 are operatively attached to head box 57 and vertical travel unit 70 to vary the cant of blade shaft from horizontal. When the wheel path is uneven or perhaps banked to the extent that the cutting blades are likely to jam or overheat because the entry of the blade is not square, the cant of the blade shaft can be adjusted to alleviate this condition.

Cant adjustment means 130 includes a bolt 126 to mounting arm 128. Two generally vertical flanges 132 are attached to the upper portion of head box 57 on either side bolt 126. A flange opposes each side of arm 128. Screws 134 are threaded through each flange 132 and are engagable with springs 136 to pivot head box 57 about bolt 126 and therefore adjust the cant of the cutting blades. The degree canting is set by moving jam nuts 138 against flanges 132. It should be apparent that springs 136 provide smooth cant adjustment and dampen any vibrations or recoils experienced during cutting especially when harder materials are encountered. This improves the performance and life of the relative expensive cutting blades. Squarely starting the cut with respect to the surface of the pavement helps avoid breakage of the blades and reduces alignment problems like skidding and wandering. If the blades do not start squarely, they tend to skid, walk, or wander off the desired location.

As shown in FIG. 8, water for dust abatement and cooling is sprayed along the lower portion of blades 58A1 et. seq. The water is drawn from a tanker towed nearby (not shown) and distributed to the blades via a hose 115 connected to a spray bar 116 mounted on the lower portion of head box 57 adjacent to wheels 30 and cutting blades 58A1 et. seq.

Figure 14:
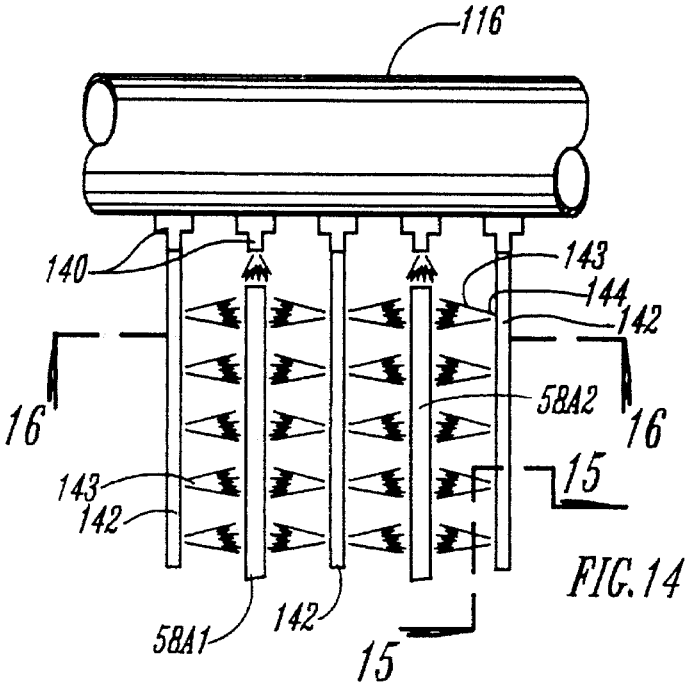
FIG. 14 is a schematic top view of the means for cooling the cutting blades of the present invention.

Spray bar 116 is specially adapted to effectively deliver coolant to the cutting blades. FIG. 14 shows that each set or pair of cutting blades 58A1, 58A2, et. seq. is addressed by a plurality of nozzles 140 mounted on spray bar 116 adjacent and generally perpendicular to the edges of blades 58A1, 58A2, et. seq. In the preferred embodiment, each pair of blades has five nozzles associated therewith. One of the nozzles is directed toward the edge of each cutting blade. The three remaining nozzles have a capped tube 142 fluidly connected thereto.

Figure 15:
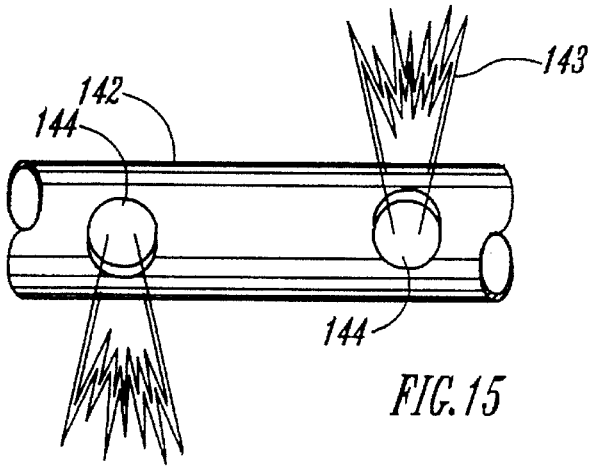
FIG. 15 is an enlarged view of the perforated tubing used to spray coolant on the cutting blades of the present invention.
Figure 16:
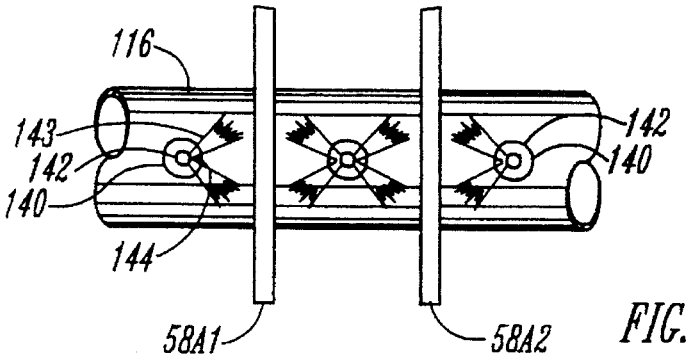
FIG. 16 is a schematic front view of the means for cooling the cutting blades of the present invention.

Tube 142 runs radially inward and substantially parallel alongside the blade. Spaced apart perforations 144 allow cooling water represented by sprays 143 to be directed toward various areas along the sides of the blades. As shown in FIG. 15, the perforations are drilled such that the perforations 144 alternately direct water sprays 143 upward or downward slightly. This increases the total effective area of the blade covered by coolant. Therefore, the blade is more effectively cooled. FIG. 16 shows the multitude of sprays 143 directed at a typical portion of the blade, especially from the tube 142 that is located between the pair of blades.

The cutting process generates a slurry of fine pavement particles and water. To deal with this problem, vacuum is created by a hydraulically driven air blower 48 removing air from the top of separator tank 50 and exhausting it to the atmosphere. Thereby, the water and cuttings which make up the slurry mixture are pulled from around the blades by intake hoses 53, and drawn into tank 50. Then a diaphragm pump 46 discharges the mixture from tank 50 to a suitable location.

OPERATION OF THE INVENTION

The operation of the present invention according to its preferred embodiment will now be described in detail. The slot cutting machine 26 is driven or transported to the site with the cutting head assemblies 54 raised so as to be spaced above the road surface and laterally retracted as necessary to meet the maximum legal and unrestricted width, normally eight feet. The machine 26 is then driven to and aligned with a transverse joint 16 as shown in FIG. 1. The parking brake assembly 38 is hydraulically set and locked to insure there is no shifting of the machine relative to the pavement surface. The cant of each blade shaft 66 is set to insure a proper angle of blade entry. A conventional water tanker (not shown) is connected to slurry control system 44 and spray bar 116. The cutting head assemblies 54 are laterally extended to the proper location above each wheel path 12 and 14 as seen in FIGS. 1 and 6.

Figure 12A:
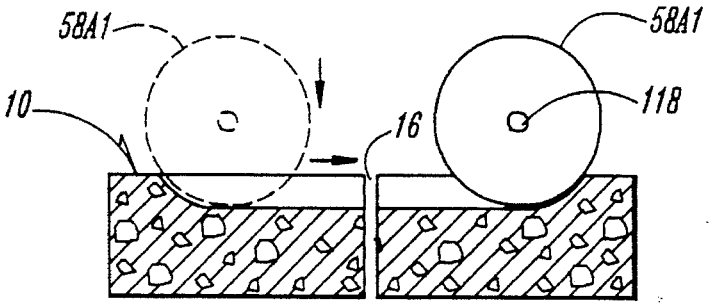
FIGS. 12A, 12B, 12C, and 12D are views of a cutting blade at various stages of cutting a side wall for a slot according to the method of this invention.

The position and movement of the blades during the cutting process is shown in FIGS. 12A, 12B, 12C and 12D. First, the blades are powered to rotate at a speed known in the art to be appropriate for cutting pavement with diamond-impregnated blades. The slurry control system 44 is activated just before the blades engage the pavement. Both cutting heads 54 are independently plunged or lowered about two inches deep into the pavement by hydraulically activating vertical travel unit 70. Alternatively, both cutting heads can be moved in unison. Then the horizontal travel unit 78 is hydraulically activated to move the rotating cutting blade 58A1 longitudinally or rearwardly in a first direction perpendicular to its axes of rotation 118, approximately nineteen inches. This first pass is illustrated in FIG. 12A, with the initial position shown in broken lines, and the position at the end of the horizontal movement shown in solid lines.

Figure 12B:
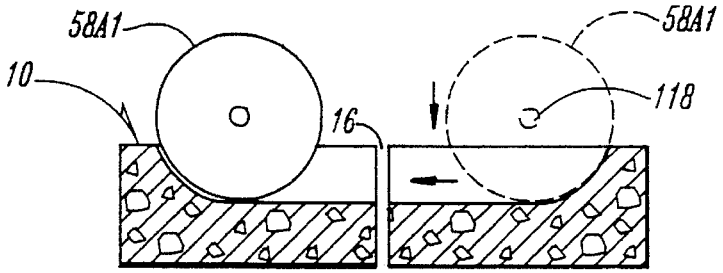
Figure 12C:
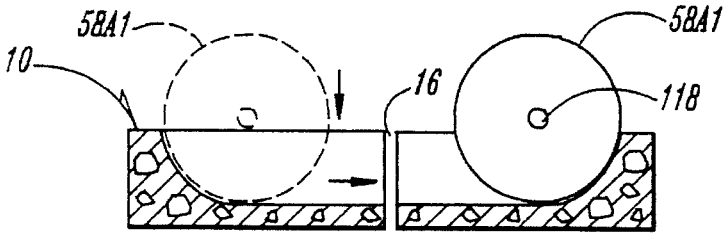
Figure 12D:
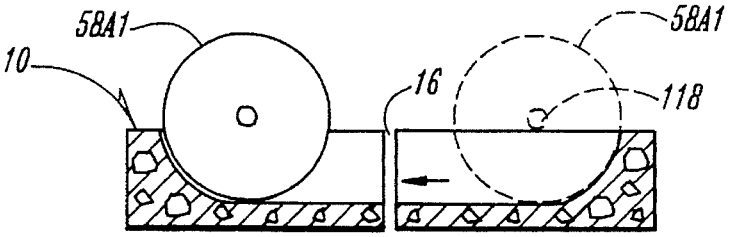

Next, cutting head assembly 54 which includes the blades is plunged or lowered two more inches. Then, cutting blades are moved approximately nineteen inches horizontally in the opposite direction. This second pass is illustrated in FIG. 12B. Next, the cutting head assembly 54 and rotating blade 58A1 are plunged to the total depth of 5.75 inches in the preferred embodiment, and moved nineteen inches horizontally in the first direction. The third pass goes to final depth as shown in FIG. 12C. On the fourth and final pass the blade returns in the other direction, as is illustrated in FIG. 12D. The fourth pass is primarily a cleanup cut at final depth to ensure a smooth, level bottom. The cutting blades are also therefore properly positioned at the longitudinal point of origin in order to begin cutting the next slots. The cutting head assembly 54 is hydraulically raised from the cut by vertical travel unit assembly 70. The spray bar 116 and slurry control system 44 can be deactivated after the blades are removed from the cut.

This multiple pass method results in long blade life and relatively infrequent changes of the expensive blades. The cuts for all six slots 18A–F can be held to a consistent and uniform depth. Furthermore, the parallelism and spacing between the cuts is accurately maintained, despite the high rate of production which is achieved.

The parking brakes are released and the slot cutting machine 26 is driven to the next transverse joint. The steps of the preceding two paragraphs are then repeated until it is time to clear the road. The pavement between the adjacent pairs of the cut is removed by a jack hammer to define the slots 18A–18F.

Figure 13:
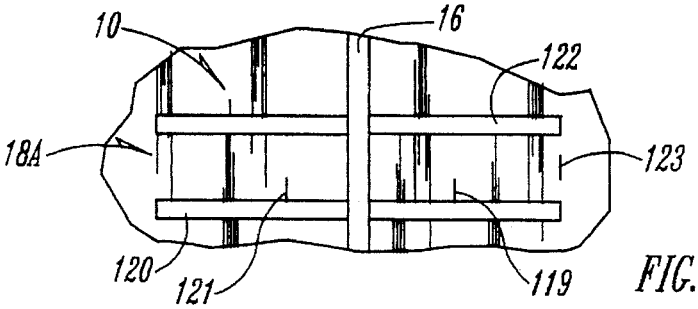
FIG. 13 is an enlarged top view of one slot after the pavement has been cut and shows the locations where the pavement is struck to quickly remove it from the slot.

One aspect of the method of the present invention addresses the problem of speeding up the removal of pavement between the side walls cut by the slot cutting machine. It has been determined that the pavement between the side walls of the slot 18A can effectively be removed with only three hits from a hand-held jack hammer. The jack hammer is conventional, but a specially modified blade is used in the preferred embodiment. A standard three inch wide steel spade bit is ground to a width of 2.0 to 2.25 inches, preferably 2.25. This blade width works well because it substantially spans, but does not exceed, the width of slot 18A. As shown in FIG. 13, the first hit or impact of the jack hammer blade is made at the spot designated 119 (about six inches from the joint 16 and both adjacent and perpendicular to cut 120). This results in a clean fracture across the bottom of the right half of slot 18A between the cuts 120 and 122. The second impact is applied at the spot designated 121, (about six inches from joint 16 perpendicular to cut 120). This results in a clean fracture across the bottom of the left half of slot 18A between the cuts 120 and 122. The third and final impact is applied at the spot designated 123 (midway between cuts 120 and 122 and perpendicular to them at one end). This hit is prolonged for about two to three seconds and made with a scooping motion toward the other end of the slot, thereby breaking the pavement into only two chunks which are easily removed. The slot bottom is also purged by the jack hammer as it is scooped toward the other end of slot 18A.

After the slot 18A has been purged, it is sand blasted clean to provide good bonding surfaces. Later, the slot is refilled with the appropriate bonding material in order to make the road ready for vehicular traffic again. Generally, a surface grinding operation must also be completed before the dowel bar retrofitted pavement will meet specifications.

It should be understood that many variations of the above-discussed means and methods of cutting slots would be apparent to one skilled in the art without departing from the essence of this invention. For example, one cutting head assembly could be engaged in cutting a set of slots in one wheel path while the other cutting head remains retracted and idle. This feature is helpful in cutting slots at skewed joints and random cracks. Because the heads are independent, with each having their own straddle wheels for setting the depth of cut, a different depth can be maintained in one wheel path as opposed to the other. With the various independent hydraulic means employed, it is contemplated that the blades of one cutting head assembly can be operated at different rotating, plunging, or traversing speeds as differing pavement conditions might dictate. The method of this invention can utilize a greater or lesser number of passes with the incumbent impact on blade life.

Therefore, it should be noted that the present invention achieves at least all of the stated objectives. It will be appreciated that the present invention can take many forms and embodiments. The true essence and spirit of this invention are defined in the claims appended hereto. It is not intended that the embodiment of the invention presented herein should limit the scope thereof. The precise dimensions of the components can vary within ranges as appreciated by those skilled in the art. The materials can also vary such as understood by and within the knowledge of those skilled in the art.

What is claimed is:

1. A method for simultaneously cutting a plurality of parallel slots in a surface with a plurality of parallel cutting blades rotatably mounted on a frame, the method comprising:

maintaining the frame in a locked position relative to the surface;

lowering the rotating blades to make a plurality of parallel cuts in the surface;

moving the rotating blades horizontally relative to the frame so as to elongate the cuts; and removing material between adjacent cuts to form a plurality of parallel slots in the surface.

2. The method of claim 1 comprising the additional steps of further lowering the rotating blades and moving the blades horizontally in an opposite direction so as to deepen the cuts in the surface.

3. The method of claim 1 further comprising providing a cooling liquid to the rotating blades so as to cool the blades during cutting.

4. The method of claim 3 wherein a slurry is produced from the rotating blades and cooling liquid during cutting, the method further comprising vacuuming the slurry for removal of the slurry.

5. The method of claim 3 wherein providing a cooling liquid to the blades comprises directing water at the edge of the blades and both sides of the blades from several directions at once.

6. The method of claim 1 wherein the lowering of the blades is hydraulically controlled.

7. The method of claim 1 wherein the horizontal movement of the blades is hydraulically controlled.

8. The method of claim 1 further comprising moving the blades laterally relative to the frame for positioning the blades at given lateral locations above the surface.

9. The method of claim 8 wherein the lateral movement of the blades is hydraulically controlled.

10. A method for simultaneously cutting a plurality of parallel slots in a road surface with a plurality of parallel pairs of rotatable cutting blades mounted on a prime mover, the method comprising:

positioning the prime mover in a desired location on the surface with the blades positioned above a portion of the surface in which slots are to be cut;

locking the prime mover against movement relative to the surface;

actuating the blades for rotation about a common axis;

lowering the rotating blades into the surface to a first depth so as to make a plurality of parallel pairs of cuts in the surface;

moving the rotating blades horizontally in a first direction perpendicular to the rotational axis and relative to the prime mover and the surface so that the cuts are elongated;

further lowering the rotating blades into the surface to a second depth so as to deepen the cuts;

moving the rotating blades horizontally in a second direction opposite the first direction and relative to the prime mover and the surface so that the deepened cuts in the surface are elongated;

raising the blades from the cuts;

moving the prime mover to provide access to the cuts; and removing the road surface between pairs of cuts so as to form a plurality of parallel slots in the road surface.

11. The method of claim 10 wherein the road surface between pairs of cuts is removed by jackhammering.

12. The method of claim 10 wherein the cutting of slots is to a depth of at least 4 inches.

13. A method for reinforcing transverse joints in roads, comprising:

positioning a slot cutting machine over a road joint and locking the machine in such position so that the machine does not move relative to the joint;

lowering a cutting head having a plurality of rotating parallel cutting blades into the road so as to simultaneously make a plurality of parallel cuts in the road;

moving the rotating blades horizontally so as to elongate the cuts while maintaining the locked position of the machine over the joint;

raising the blades from the road;

moving the machine from the joint;

removing road material between adjacent cuts so as to form a plurality of parallel slots in the road;

placing dowel bars into the slots; and filling the slots with new road material.

14. The method of claim 13 further comprising placing chairs within the slots and placing said rods into said chairs, thereby positioning said bars within the slots.

15. The method of claim 14 wherein the placement of chairs into the slots includes wedging the chairs within the slots.

16. The method of claim 13 wherein the step of removing the road surface at an expansion joint thereof between adjacent cuts includes substeps comprising:

applying a first impact force at a first location on the road surface adjacent and perpendicular to one of the cuts;

applying a second impact force at a second location on the road surface adjacent and perpendicular to one of the cuts on the opposite side of the joint from the first location; and applying a plurality of impact forces between the adjacent cuts which form one of the slots, whereby the road surface is broken and removed from between the adjacent cuts to provide a slot.

17. The method of claim 13 further comprising the step of canting the rotational axis of the blades from a horizontal plane to compensate for variations from horizontal in the surface before lowering the blades.

18. The method of claim 13 wherein the machine has multiple cutting heads, each of which can be lowered, moved, and raised, and the steps of lowering, moving and raising each of said cutting heads are done independently of the other cutting heads.

19. The method of claim 13 wherein said positioning step comprises adjusting the lateral distance between the cutting heads.

20. The method of claim 13 further comprising making repeated horizontal passes with the blades being lowered at the beginning of each pass.

21. An apparatus for cutting a plurality of parallel slots in a surface, comprising:

a frame;

first power means for moving the frame along the surface;

a brake for locking the frame against movement relative to the surface;

a plurality of parallel cutting blades rotatably mounted on the frame;

second power means for rotating the blades;

first means on the frame for raising and lowering the blades relative to the frame and to the surface; and second means on the frame for moving the blades forwardly and rearwardly relative to the frame and to the surface.

22. The apparatus of claim 21 further comprising third means for moving the blades laterally with respect to the frame.

23. The apparatus of claim 22 wherein the first, second and third means are each hydraulic ram means.

24. The apparatus of claim 21 further comprising means for supplying a cooling liquid to the blades operatively mounted adjacent said blades.

25. The apparatus of claim 24 wherein said means for supplying coolant includes a spray bar mounted on the frame and disposed generally perpendicular to the blades, said spray bar having a plurality of nozzles, a trio of said nozzles being directed toward each respective blade, the center nozzle of said trio of nozzles being directed toward the edge of said respective blade and the outer nozzles of said trio each having a capped tube extending therefrom along either side of said respective blade, each of said capped tubes having a series of spaced-apart perforations from which coolant is sprayed on the sides of the blade.

26. The apparatus of claim 25 wherein said perforations are formed in the tubes so as to alternately angle the spray of coolant upwardly and downwardly at the blades.

27. The apparatus of claim 21 further comprising vacuum means for vacuuming a slurry produced by the rotating blades during operation, said vacuum means being operatively positioned adjacent said blades and opposite said means for supplying cooling liquid.

28. The apparatus of claim 22 further comprising a canting means on the frame operatively attached to the blades for tilting the blades away from a vertical plane.

29. The apparatus of claim 28 wherein said canting means is comprised of adjustable spring means for urging the blades to pivot in a vertical plane about a pivot point where said blades are mounted to said frame.

30. The apparatus of claim 28 wherein said plurality of parallel cutting blades are rotatably mounted both on a first cutting head and on a second cutting head, said first and second cutting heads being independently movable.

31. The apparatus of claim 21 wherein the first power means and the second means are independently operable.

* * * * *